US006965348B2

(12) United States Patent
Caimi et al.

(10) Patent No.: US 6,965,348 B2
(45) Date of Patent: Nov. 15, 2005

(54) BROADBAND ANTENNA STRUCTURES

(75) Inventors: Frank M. Caimi, Vero Beach, FL (US); Sean F. Sullivan, Palm Bay, FL (US)

(73) Assignee: SkyCross, Inc., Melbourne, FL (US)

( * ) Notice: Subject to any disclaimer, the term of this patent is extended or adjusted under 35 U.S.C. 154(b) by 0 days.

(21) Appl. No.: 10/878,909

(22) Filed: Jun. 28, 2004

(65) Prior Publication Data

US 2004/0233115 A1 Nov. 25, 2004

Related U.S. Application Data

(63) Continuation of application No. 10/120,293, filed on Apr. 10, 2002, now abandoned.

(60) Provisional application No. 60/282,888, filed on Apr. 10, 2001.

(51) Int. Cl.[7] ..... H01Q 1/00; H01Q 9/00
(52) U.S. Cl. ..... 343/722; 343/749
(58) Field of Search ..... 343/722, 745, 343/748, 749, 895

(56) References Cited

U.S. PATENT DOCUMENTS 5,790,080 A * 8/1998 Apostolos ..... 343/744

* cited by examiner

*Primary Examiner*—Michael C. Wimer
(74) *Attorney, Agent, or Firm*—John L. DeAngelis, Jr.; Beusse Brownlee Wolter Mora & Maire, P.A.

(57) ABSTRACT

There is disclosed an antenna exhibiting resonance over a broad frequency band or over a plurality of closely-spaced frequency bands, comprising a ground plane, a non-driven element affixed substantially perpendicular to the ground plane, a driven element affixed substantially perpendicular to the ground plane and a horizontal conductor electrically connected between the driven and the non-driven elements and disposed substantially parallel to the ground plane. The non-driven and the driven elements further comprise periodic slow wave structures. The periodic slow wave structures are configured to provide a substantially constant propagation factor with respect to the applied signal frequency, such that the antenna exhibits broad resonance characteristics.

2 Claims, 6 Drawing Sheets

BROADBAND ANTENNA STRUCTURES

This patent application claims the benefit of U.S. Provisional Application No. 60/282,888 filed on Apr. 10, 2001.

The present application is a continuing application claiming the benefit of the application filed on Apr. 10, 2002, and assigned application Ser. No. 10/120,293, now abandoned which claims the benefit of the provisional patent application filed on Apr. 10, 2001, and assigned application Ser. No. 60/282,888.

FIELD OF THE INVENTION

This invention relates generally to antennas comprising slow wave structures, and especially to such antennas offering broadband performance.

BACKGROUND OF THE INVENTION

It is generally known that antenna performance is dependent upon the size, shape and material composition of the constituent antenna elements, as well as the relationship between certain antenna physical parameters (e.g., length for a linear antenna and diameter for a loop antenna) and the wavelength of the signal received or transmitted by the antenna. These relationships determine several antenna operational parameters, including input impedance, gain, directivity and the radiation pattern. Generally for an operable antenna, the minimum physical antenna dimension (or the electrically effective minimum distance) must be on the order of a quarter wavelength (or a multiple thereof) of the operating frequency, which thereby advantageously limits the energy dissipated in resistive losses and maximizes the energy transmitted. Quarter wave length and half wave length antennas are the most commonly used.

The burgeoning growth of wireless communications devices and systems has created a substantial need for physically smaller, less obtrusive, and more efficient antennas that are capable of wide bandwidth or multiple frequency band operation, and/or operation in multiple modes (i.e., selectable radiation patterns or selectable signal polarizations). Smaller packaging of state-of-the-art communications devices does not provide sufficient space for the conventional quarter and half wave length antenna elements. As is known to those skilled in the art, there is a direct relationship between physical antenna size and antenna gain, at least with respect to a single-element antenna, according to the relationship: gain=$(\beta R)^2+2\beta R$, where R is the radius of the sphere containing the antenna and $\beta$ is the propagation factor. Increased gain thus requires a physically larger antenna, while users continue to demand physically smaller antennas. As a further constraint, to simplify the system design and strive for minimum cost, equipment designers and system operators prefer to utilize antennas capable of efficient multi-frequency and/or wide bandwidth operation. Finally, gain is limited by the known relationship between the antenna frequency and the effective antenna length (expressed in wavelengths). That is, the antenna gain is constant for all quarter wavelength antennas of a specific geometry i.e., at that operating frequency where the effective antenna length is a quarter of a wavelength of the operating frequency.

One basic antenna commonly used in many applications today is the half-wavelength dipole antenna. The radiation pattern is the familiar donut shape with most of the energy radiated uniformly in the azimuth direction and little radiation in the elevation direction. Frequency bands of interest for certain communications devices are 1710 to 1990 MHz and 2110 to 2200 MHz. A half-wavelength dipole antenna is approximately 3.11 inches long at 1900 MHz, 3.45 inches long at 1710 MHz, and 2.68 inches long at 2200 MHz. The typical gain is about 2.15 dBi.

The quarter-wavelength monopole antenna placed above a ground plane is derived from a half-wavelength dipole. The physical antenna length is a quarter-wavelength, but with the ground plane the antenna performance resembles that of a half-wavelength dipole. Thus, the radiation pattern for a monopole antenna above a ground plane is similar to the half-wavelength dipole pattern, with a typical gain of approximately 2 dBi.

The common free space (i.e., not above ground plane) loop antenna (with a diameter of approximately one-third the wavelength) also displays the familiar donut radiation pattern along the radial axis, with a gain of approximately 3.1 dBi. At 1900 MHz, this antenna has a diameter of about 2 inches. The typical loop antenna input impedance is 50 ohms, providing good matching characteristics.

The well-known patch antenna provides directional hemispherical coverage with a gain of approximately 4.7 dBi. Although small compared to a quarter or half wave length antenna, the patch antenna has a relatively narrow bandwidth.

Given the advantageous performance of quarter and half wavelength antennas, conventional antennas are typically constructed so that the antenna length is on the order of a quarter wavelength of the radiating frequency, and the antenna is operated over a ground plane. These dimensions allow the antenna to be easily excited and operated at or near a resonant frequency, limiting the energy dissipated in resistive losses and maximizing the transmitted energy. But, as the operational frequency increases/decreases, the operational wavelength decreases/increases and the antenna element dimensions proportionally decrease/increase.

Thus antenna designers have turned to the use of so-called slow wave structures where the structure physical dimensions are not equal to the effective electrical dimensions. Recall that the effective antenna dimensions should be on the order of a half wavelength (or a quarter wavelength above a ground plane) to achieve the beneficial radiating and low loss properties discussed above. Generally, a slow-wave structure is defined as one in which the phase velocity of the traveling wave is less than the free space velocity of light. The wave velocity is the product of the wavelength and the frequency and takes into account the material permittivity and permeability, i.e., $c/((\mathrm{sqrt}(\epsilon_r)\mathrm{sqrt}(\mu_r))=\lambda f$. Since the frequency remains unchanged during propagation through a slow wave structure, if the wave travels slower (i.e., the phase velocity is lower) than the speed of light, the wavelength within the structure is lower. Thus a half wavelength slow wave structure (or any other wavelength multiple) is shorter than a half wavelength structure where the wave propagates at the speed of light (c). The slow-wave structure de-couples the conventional relationship between physical length, resonant frequency and wavelength. Slow wave structures can be used as antenna elements (i.e., feeds) or as antenna radiating structures.

Since the phase velocity of a wave propagating in a slow-wave structure is less than the free space velocity of light, the effective electrical length of these structures is greater than the effective electrical length of a structure propagating a wave at the speed of light. The resulting resonant frequency for the slow-wave structure is correspondingly increased. Thus if two structures are to operate at the same resonant frequency, as a half-wave dipole, for instance, then the structure propagating the slow wave will be physically smaller than the structure propagating the wave at the speed of light.

Slow wave structures are discussed extensively by A. F. Harvey in his paper entitled *Periodic and Guiding Structures at Microwave Frequencies*, in the IRE Transactions on Microwave Theory and Techniques, January 1960, pp. 30–61 and in the book entitled *Electromagnetic Slow Wave Systems* by R. M. Bevensee published by John Wiley and Sons, copyright 1964. Both of these references are incorporated by reference herein.

A transmission line or conductive surface on a dielectric substrate exhibits slow-wave characteristics, such that the effective electrical length of the slow-wave structure is greater than its actual physical length, according to the equation, $$l_e=(\epsilon_{eff}^{1/2})\times l_p,$$

where $l_e$ is the effective electrical length, $l_p$ is the actual physical length, and $\in_{eff}$ is the dielectric constant ($\in_r$) of the dielectric material proximate the transmission line.

A prior art meanderline, which is one example of a slow wave structure, comprises a conductive pattern (i.e., a traveling wave structure) over a dielectric substrate, overlying a conductive ground plane. An antenna employing a meanderline structure, referred to as a meanderline-loaded antenna or a variable impedance transmission line (VITL) antenna, is disclosed in U.S. Pat. No. 5,790,080. The antenna consists of two vertical spaced apart conductors and a horizontal conductor disposed therebetween, with a gap separating each vertical conductor from the horizontal conductor.

The antenna further comprises one or more meanderline variable impedance transmission lines bridging the gap between the vertical conductor and each horizontal conductor. Each meanderline coupler is a slow wave transmission line structure carrying a traveling wave at a velocity lower than the free space velocity. Thus the effective electrical length of the slow wave structure is greater than its actual physical length. Consequently, smaller antenna elements can be employed to form an antenna having, for example, quarter-wavelength properties. As for all antenna structures, the antenna resonant condition is determined by the electrical length of the meanderlines plus the electrical length of the radiating elements.

Although the meanderline antenna described above is essentially a narrowband antenna, a form of broadband operation can be achieved by including devices to electrically shorten the meanderlines, to change the resonant antenna frequency. In such an embodiment the slow-wave structure includes separate switchable segments (controlled, for example, by vacuum relays, MEMS (micro-electro-mechanical systems), PIN diodes or mechanical switches) that can be inserted in and removed from the circuit by action of the associated switch. This switching action changes the effective electrical length of the meanderline coupler and thus changes the effective length of the antenna. Losses are minimized in the switching process by placing the active switching structure in the high impedance sections of the meanderline. Thus the current through the switching device is low, resulting in very low dissipation losses and a high antenna efficiency. However, selecting the appropriate segments to switch to achieve the desired antenna performance is not easy.

In lieu of removing meanderline segments from the antenna by switch devices as described above, the antenna can be constructed with multiple selectable meanderlines to change the effective antenna electrical length. These are also switched into and removed from the antenna using the switching devices described above. Such antennas are disclosed and claimed in the commonly-assigned patent application entitled High Gain, Frequency-Tunable Variable Impedance Transmission Line Loaded Antenna Providing Multi-Band Operation, filed on Nov. 28, 2000 and assigned application Ser. No. 09/724,332.

The meanderline-loaded antenna allows the physical antenna dimensions to be significantly reduced, while maintaining an effective electrical length that, in one embodiment, is a quarter wavelength multiple. The meanderline-loaded antennas operate in the region where the performance is limited by the Chu-Harrington relation, that is, efficiency=FVQ, where:

Q=quality factor

V=volume of the structure in cubic wavelengths

F=geometric form factor (F=64 for a cube or a sphere)

Meanderline-loaded antennas achieve this efficiency limit of the Chu-Harrington relation while allowing the effective antenna length to be less than a quarter wavelength at the resonant frequency. Dimension reductions of 10 to 1 can be achieved over a quarter wavelength monopole antenna, while achieving a comparable gain.

BRIEF SUMMARY OF THE INVENTION

Although the meanderline antenna embodiments described above offer desirable attributes within a smaller physical volume, improved broadband operation is desirable. The antenna constructed according to the teachings of the present invention provides broadband operation by incorporating periodic slow wave structures that maintain a resonant condition over a wide frequency range or over a plurality of closely-spaced frequency ranges. Specifically, the antenna includes periodic slow wave structures in the form of a meandering conductive pattern, such as a serpentine conductive trace, a rectangular trace (a meander tape line), a tape ladder line or an interdigital meanderline. Various forms of transmission lines where the conductive segments are periodic are suitable for use as a periodic slow wave structure. The antenna of the present invention comprises a ground plane, one or more conductive elements, including a horizontal element and at least two spaced-apart vertical elements, each connected to the horizontal element by a periodic slow wave structure constructed according to the teachings of the present invention. An antenna comprising these periodic slow wave structures has a smaller physical size, yet exhibits comparable or enhanced performance over a conventional dipole antenna. Further, the operational bandwidth is greater than or at least equivalent to the bandwidth achievable using the switched segment meanderline structures described above.

BRIEF DESCRIPTION OF THE DRAWINGS

The present invention can be more easily understood in the further advantages and used there are more readily apparent, when considered in view of the description of the preferred embodiments and the following figures in which.

DETAILED DESCRIPTION OF THE INVENTION

Figure 1:
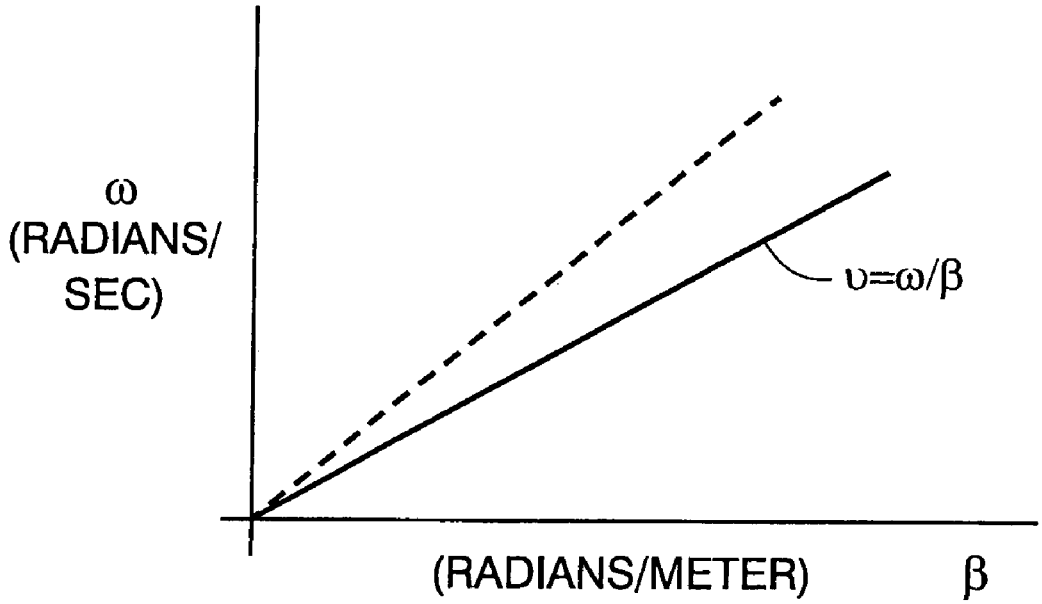
FIGS. 1 and 2 are graphs of ω (the applied signal frequency) as a function of β (the propagation factor)

Before describing in detail the particular wideband meanderline-loaded antenna constructed according to the teachings of the present invention, it should be observed that the present invention resides primarily in a novel and non-obvious combination of apparatus related to periodic slow wave structures operative in antenna structures and antenna technology in general. Accordingly, the hardware components described herein have been represented by conventional elements in the drawings and in the specification description, showing only those specific details that are pertinent to the present invention, so as not to obscure the disclosure with structural details that will be readily apparent to those skilled in the art having the benefit of the description herein.

As is known, the operational wavelength of an antenna is dependent on the applied signal frequency. The frequency is expressed in Hertz (Hz) and referred to by the letter f, or the angular frequency is expressed in radians/per second and referred to by the letter ω, where ω= 2 πf. The physical length of an antenna is referred to as $l_p$. A single traveling wave on an arbitrary structure follows the mathematical relationship below, describing its propagation along one dimension, the z-dimension in this case.

$$\psi(z)=A\exp(-j\beta z)\exp(j\omega t+\phi) \quad \text{(equation 1)}$$

The time dependence of the wave amplitude is determined by a phase function φ and the time t is measured with respect to some reference time, t=0. The spatial dependence of the wave-amplitude is determined by the propagation factor β and the distance z with respect to a reference location, such as z=0.

If a time t=0 and phase φ=0 are chosen, then the spatial dependence from equation (1) reduces to:

$$\psi(z)=A\exp(-j\beta z) \quad \text{(equation 2)}$$

Thus the wave follows a sinusoidal spatial dependency whose dimensions are governed by the value of β, referred to as the propagation factor or the phase change coefficient. A full wavelength of the applied signal is observed in the distance between z=0 and z=2π/β. β is also referred to as the phase change coefficient and has the dimensions of radians/meter; β=2π/λ, where λ is the wavelength (in meters) in the structure under consideration. The actual value of the propagation factor depends on a variety of factors and characteristics associated with the structure, including: geometry of the structure, boundaries, composition, and electrical characteristics.

Solving Maxwell's equations for a given structure or medium yields the allowed values for β in that structure. Further, these solutions describe the modes of propagation where β takes on certain values with respect to the frequency of the propagating wave, f or ω. The allowed values for βare often presented on an ω-β diagram for a given propagating mode. Standard transmission lines propagating TEM (transverse electric-magnetic) waves exhibit a linear relationship between ω and β (and thus a linear relationship between ω and the wavelength of the applied signal) over a large frequency range. The propagation speed of the wave in the structure, $v_{ph}$, is given by:

$$v_{ph}=\omega/\beta,$$

which is the slope of the line in FIG. 1. The speed of light $c=\omega/\beta_0$, where $\beta_0$ is the free space propagation factor defined as $\beta_0=2\pi/\lambda_0$, and where $\lambda_0$ is the free space wavelength, is indicated by a maximum slope (dashed line) as shown. Thus since $\beta/\beta_0$ is less than one, $v_{ph}/c$ is less than one.

The physical dimensions ($l_p$) of the antenna required for a full signal wavelength (λ) to be present on the structure at a given instant of time is related to the propagation factor by:

$$l_p=\Delta z=2\pi/\beta(\omega) \quad \text{(equation 3)}$$

where β(ω) indicates that β is a function of ω, the operating frequency. Note that equation 3 reduces to the familiar $l_p=\lambda$. Thus, as is well known in the art, for a full wavelength to be present on the structure over a band of applied frequencies, the structure must change in length as the frequency (and thus the wavelength) changes. As the frequency (ω) increases in FIG. 1, so does β, (and the wavelength decreases), thereby requiring a shorter structure according to equation (3) to support the full wavelength.

Certain propagating structures, e.g., certain slow-wave structures as described herein, provide a relatively constant value of β independent of the operating frequency ω. See for example, FIG. 2 and Harvey, page 50. In the regions $\omega_2-\omega_1=\Delta\omega_1$ and $\omega_4-\omega_3=\Delta\omega_2$, the propagation factor β(ω) is relatively constant, indicating that waves at frequencies within those ranges will all be approximately one wavelength long in the appropriately sized structure according to the equation:

$$l_p=\Delta z=2\pi/\beta(\omega)=2\pi/\beta_{constant}, \quad \text{(equation 4)}$$

where β is relatively constant between $\omega_1$ and $\omega_2$ and between $\omega_3$ and $\omega_4$. If a slow wave structure having these properties has a predominant affect on the effective antenna length, then the antenna will resonate (i.e., be a full wavelength long electrically) over the broad frequency ranges of $\Delta\omega_1$ and $\Delta\omega_2$. The ω-β graph of FIG. 2 (and FIG. 5 to be discussed below) are merely exemplary. Similar ω-β effects can be observed for other slow wave structural shapes, which will have corresponding ω-β graphs.

Figure 3:
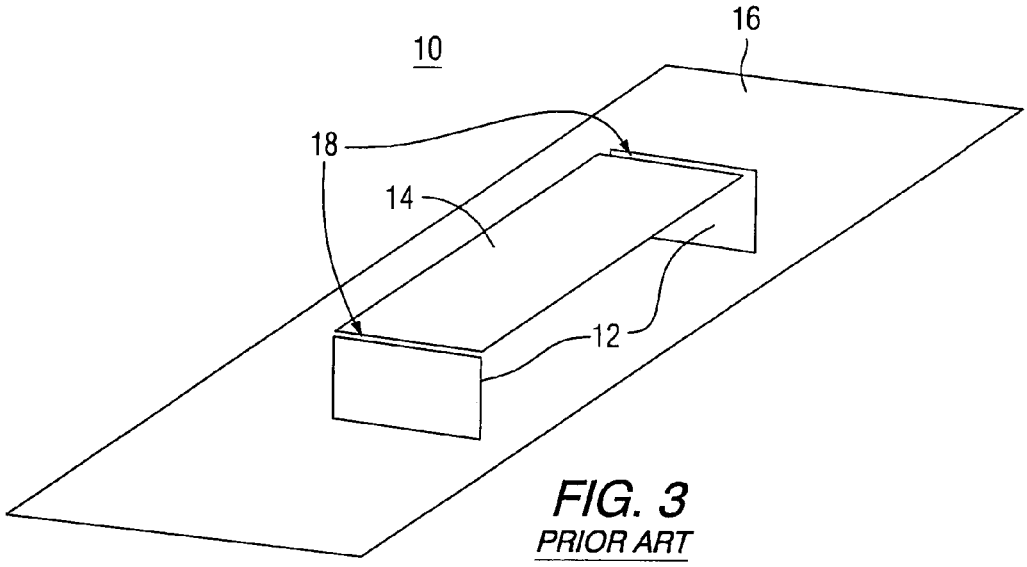
FIG. 3 PRIOR ART
FIG. 3 is a perspective view of the me anderline-loaded antenna of the prior art.

FIG. 3 depicts a perspective view of a prior art meanderline-loaded antenna 10 (also referred to as a variable impedance transmission line antenna) to which the teachings of the present invention can be advantageously applied to provide wideband or multi-band operation. The meanderline-loaded antenna 10 includes two vertical conductors 12, a horizontal conductor 14, and a ground plane 16. The vertical conductors 12 are physically separated from the horizontal conductor 14 by gaps 18, but are electrically connected to the horizontal conductor 14 by two meanderline couplers, (not shown) one for each of the two gaps 18, to thereby form an antenna structure capable of radiating and receiving RF (radio frequency) energy. According to the present invention, a periodic slow wave structure electrically bridges each gap 18.

Although illustrated in FIG. 3 as having generally rectangular plates, it is known to those skilled in the art that the vertical conductors 12 and the horizontal conductor 14 can be constructed from a variety of conductive materials and shapes. For instance, thin metallic conductors having a length greater than their width can serve as the vertical conductors 12 and the horizontal conductor 14. Single or multiple lengths of heavy gauge wire or conductive material in a filamental shape can also be used.

Figure 4B:
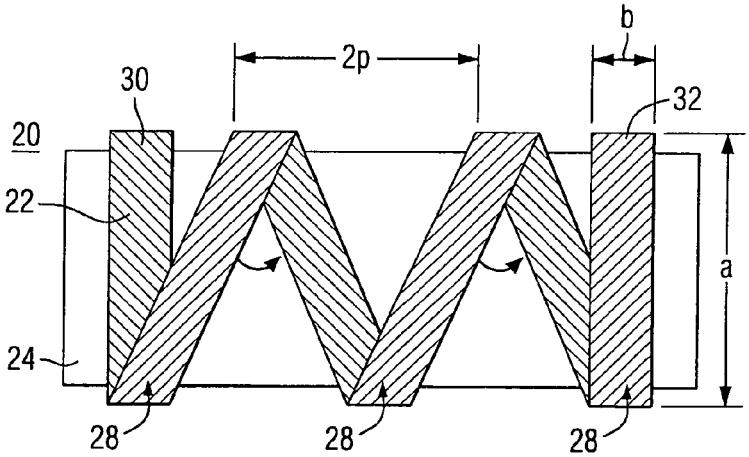
FIGS. 4A, 4B and 4C are perspective views of a periodic slow wave structure constructed according to the teachings of the present invention and used as an element coupler in the meanderline-loaded antenna FIG. 1.
Figure 4C:
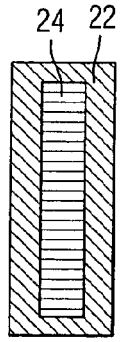
Figure 4A:
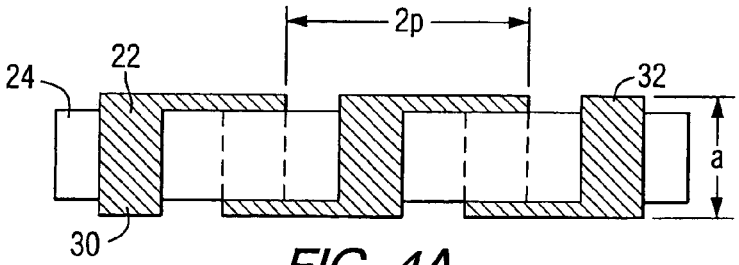

FIGS. 4A, 4B and 4C illustrate three views of a periodic slow wave structure 20 constructed according to the teachings of the present invention and usable with the meanderline-loaded antenna 10 of FIG. 3. The periodic slow wave structure is a slow wave meanderline element (or variable impedance transmission line) in the form of a conductor 22 wound around a dielectric substrate 24, i.e., a helix. Two periodic slow wave structures 20 are generally required for use with the meanderline-loaded antenna 10; one periodic slow wave structure 20 bridges each of the gaps 18 illustrated in FIG. 3. However, it is not necessary for the two periodic slow wave structures to have the same physical (or electrical) length or properties.

The periodic slow wave structure 20—configured as shown in FIGS. 4A, 4B and 4C maintains a resonant condition over a wide frequency band, in both the receive and transmit modes. As discussed above in conjunction with FIG. 1, in most structures, as the applied frequency increases, the phase velocity of the wave propagating through the structure also increases, and the wavelength of the wave propagating in the structure remains essentially unchanged. In such structures the relationship between the wavelength and frequency is governed by $c=\lambda f$. Since c is a constant, as the frequency increases, the wavelength decreases to maintain the constant product. When the wavelength decreases (or increases in response to a decreasing frequency) the resonant condition is lost as the wavelength is no longer a multiple of the antenna physical length.

Figure 2:
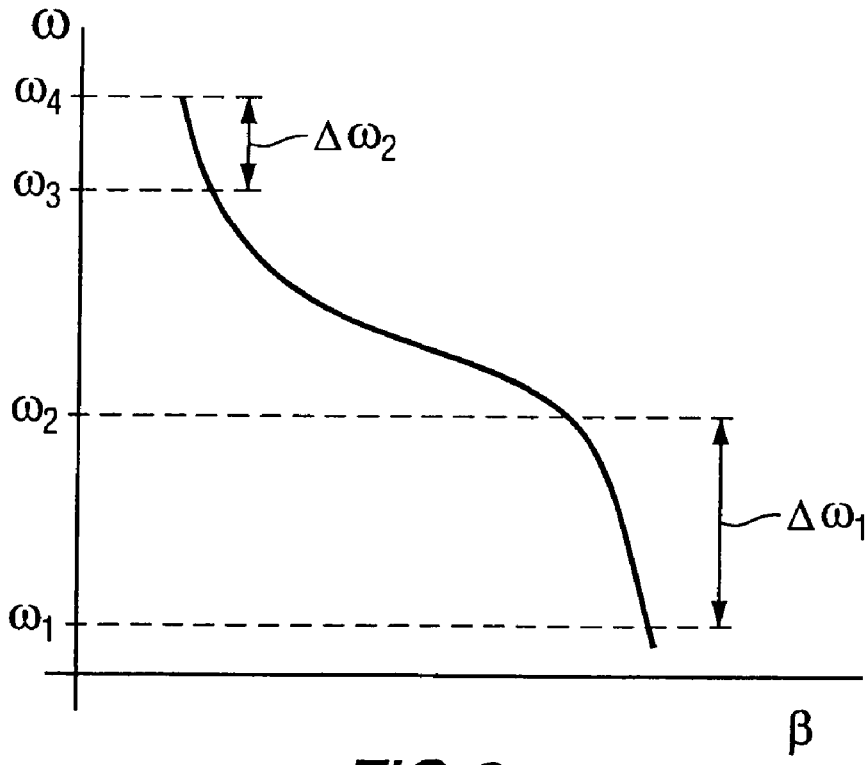

However, certain periodic slow wave structures, such as the structure of FIGS. 4A, 4B and 4C exhibit a relatively constant $\beta$ (and therefore resonant wavelength) over a range of $\omega$ values as shown in FIG. 2. Thus as the phase velocity of the wave in the structure changes, the wavelength (which is inversely related to the propagation factor, $\beta$) does not necessarily change, and a resonant condition is maintained over the ranges $\Delta\omega_1$ and $\Delta\omega_2$ referred to in FIG. 2.

The geometric configuration of the periodic slow wave structure 20 illustrated in FIGS. 4A, 4B and 4C, as well as other configurations described below, defines an $\omega$-$\beta$ curve with a relatively constant $\beta$ over certain frequency ranges (for example, $\Delta\omega_1$ and $\Delta\omega_2$ in FIG. 2). Since $\beta$ is directly related to wavelength, a relatively constant $\beta$ results in a relatively constant wavelength. It has been shown that for the periodic slow wave structure 20, the ratio of the conductor width to the spatial half period should be greater than about 0.7 to create a nearly constant propagation factor in the frequency range (in radians per second) of about 0.05 $\pi c/a$ to about 0.20 $\pi c/a$. The spatial period is defined as the conductor length forming one turn about the dielectric substrate 24.

Figure 7:
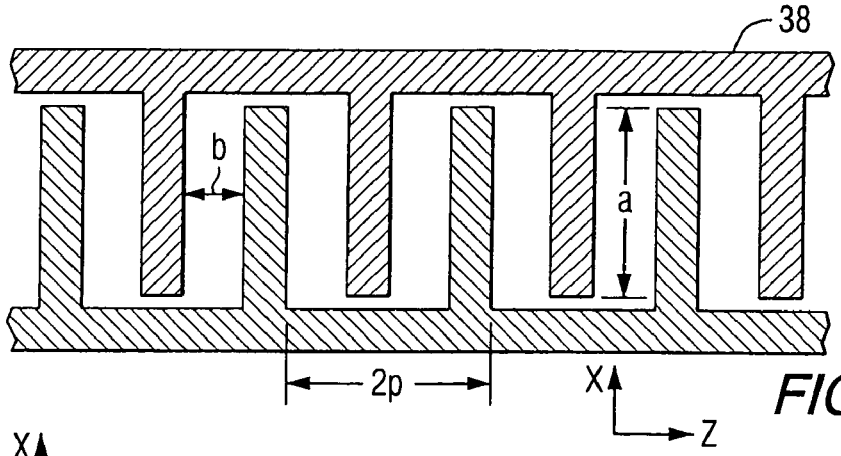
FIGS. 6, 7, 8, 9 and 10 illustrate periodic slow wave structures according to the teachings of the present invention.
Figure 6:
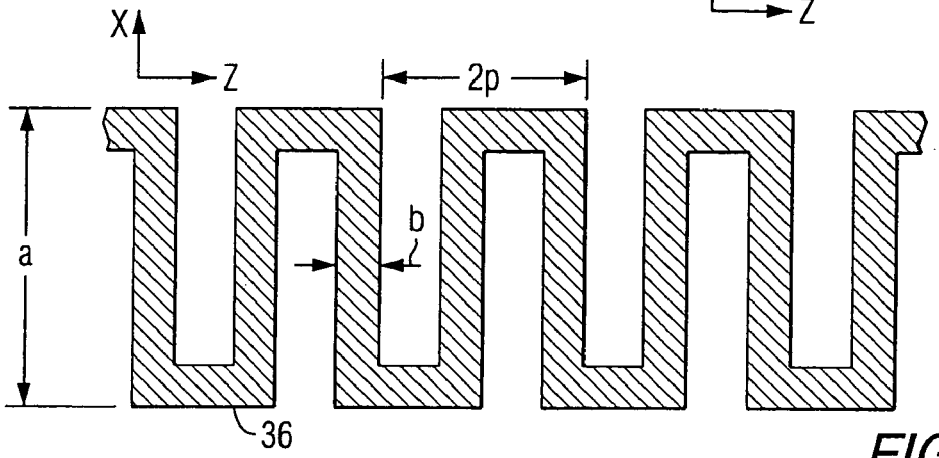
Figure 5:
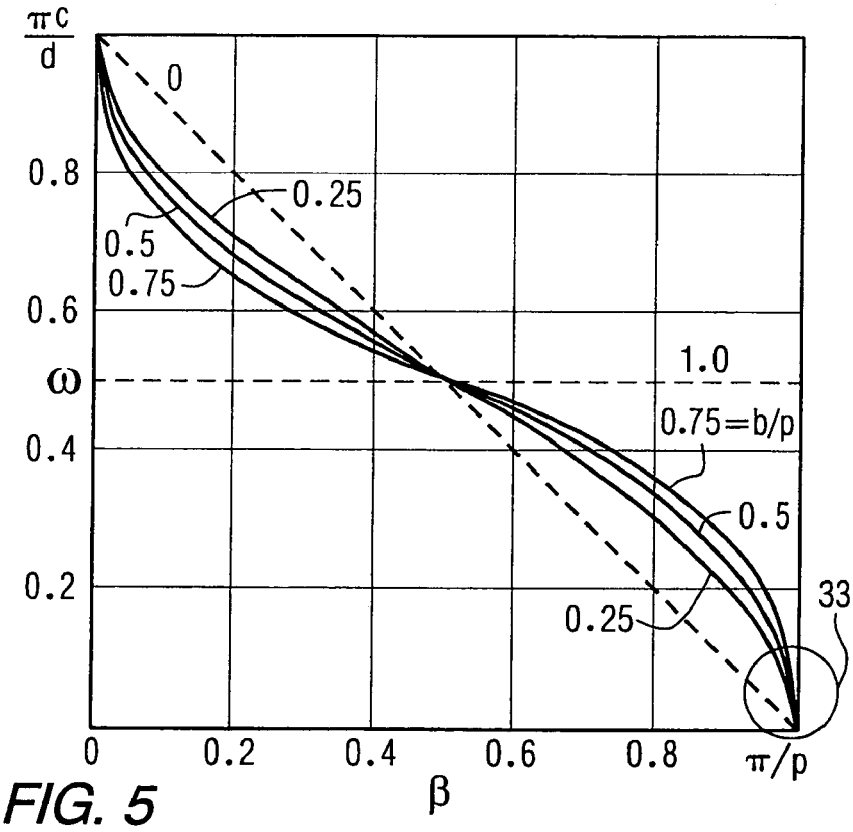
FIG. 5 is a ω-β graph of a periodic slow wave structure constructed according to the teachings of the present invention.

FIG. 5 is an $\omega$-$\beta$ curve for the exemplary periodic slow wave structure of FIG. 6, referred to as a meander tape line 36 (resembling a train of periodic rectangles or square waves). Similar $\omega$-$\beta$ curves govern this relationship for the meanderline coupler 20 and an interdigital tape line 38 of FIG. 7. As can be seen from this $\omega$-$\beta$ curve, $\beta$ is relatively constant with respect to $\omega$ in a region 33, where $\beta$ is about $\pi/p$, where p is the periodic pitch of the spatial variations defined for the meander tape line 36 and for the interdigital tape line 38 as shown. The frequency range $\Delta\omega$ over which $\beta$ is constant (vertical) extends to 0, but the practically useful region where broadband operation can be achieved is where $\omega$ is about $(0.1)\pi c/a$, (where c is the speed of light in meters/second and a is the dimension indicated in FIGS. 6 through 10) and where $\beta$ is approximately $(0.95)\pi/p$. Assuming a=10 mm, then from $\omega=(0.1)\pi c/a$, the resonant condition occurs in the region around about 1.5 GHz. Also, if p= 10 mm then $\beta$=0.3/mm. From (equation 4) which relates z and $\beta$, z is determined to be about 20 mm. Note that FIG. 5 includes five different $\omega$-$\beta$ curves for b/p ratios of 0, 0.25, 0.5,0.75 and 1, where the dimension b is shown in FIG. 4B for the coupler 20, and in FIGS. 6 and 7 for the meander tape line 36 and the interdigital tape line 38, respectively.

The phase velocity ($v_{ph}$) in these structures in the regions where $\beta$ is relatively constant is governed by:

$$v_{ph}=\omega/\beta_{constant}.$$

Since the phase velocity is directly proportional to the frequency, the wave travels faster (the phase velocity increases) to cover the requisite distance (a wavelength) as the frequency increases. Thus the wavelength is held relatively constant.

The capacitance created by the crossover configuration of the periodic slow wave structure 20 contributes to the nearly constant electrical length over the bandwidth where the propagation factor is relatively constant as the frequency changes. Intuitively, one may consider the parasitic capacitance formed by crossovers 28 as a movable short circuit that changes position as the frequency changes. At low frequencies the reactance of the crossover capacitor is low and therefore the signal propagates along the entire length of the conductor 22. At higher frequencies the capacitance at the crossovers 28 effectively shorts the conductor 22, making the conductor 22 appear shorter to the traveling wave. With respect to the periodic slow wave structures of FIGS. 6 and 7, the effect can explained by recognizing that the wave traveling in the structure couples (due to inter-element coupling) more easily between periodic sections as the frequency increases.

Certain slow wave structures (referred to as non-TEM devices) such as coupled resonators (see for example, RCA Review, volume 19, page 283, 1958), support multiple modes in addition to the TEM mode. That is, there is more than a single propagation factor $\beta$ (each one representing one operational mode) for a given frequency or range of frequencies. Thus an antenna constructed with these periodic slow wave structures resonates at a band of frequencies in one mode and a second band of frequencies in another mode. The result is an antenna capable of multi-band or broadband operation.

Figure 8:
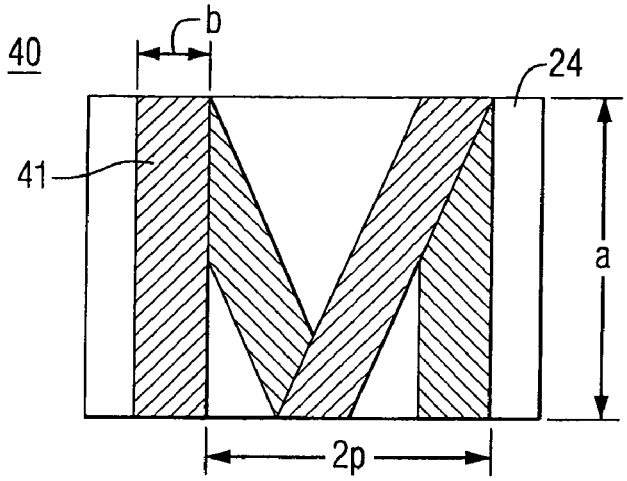

FIG. 8 illustrates another periodic slow wave structure 40, comprising a conductor 41 wound around the dielectric substrate 24, that exhibits an approximately constant propagation factor over a frequency band. The relevant dimensions of the periodic slow wave structure 40, are indicated in FIG. 8. The relationship between $\omega$ and $\beta$ for the periodic slow wave structure 40 is governed by a curve similar to FIG. 5.

Figure 9:
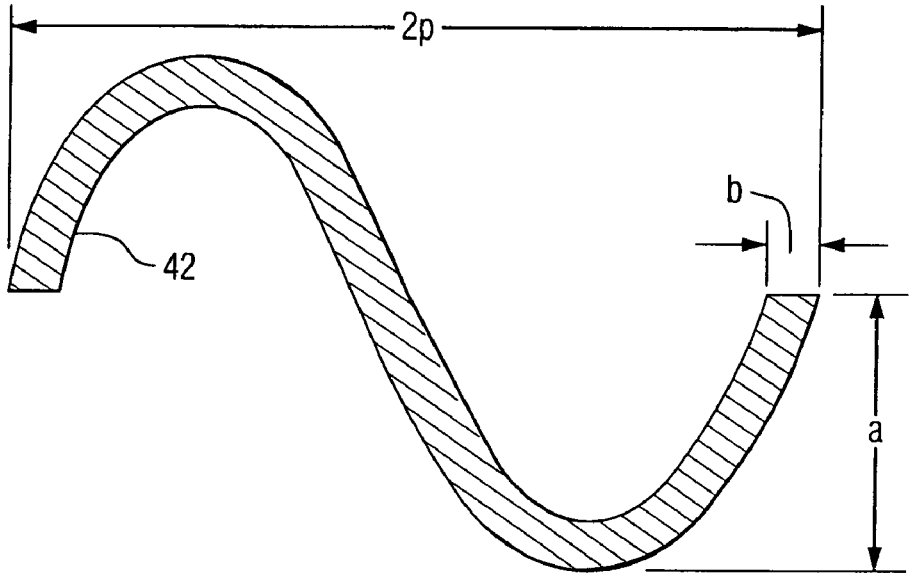

FIG. 9 illustrates a serpentine meanderline periodic slow wave structure 42, that exhibits an approximately constant propagation factor over a band of frequencies. The relevant dimensions governing the ω-β characteristics are indicated in FIG. 9.

Figure 10:
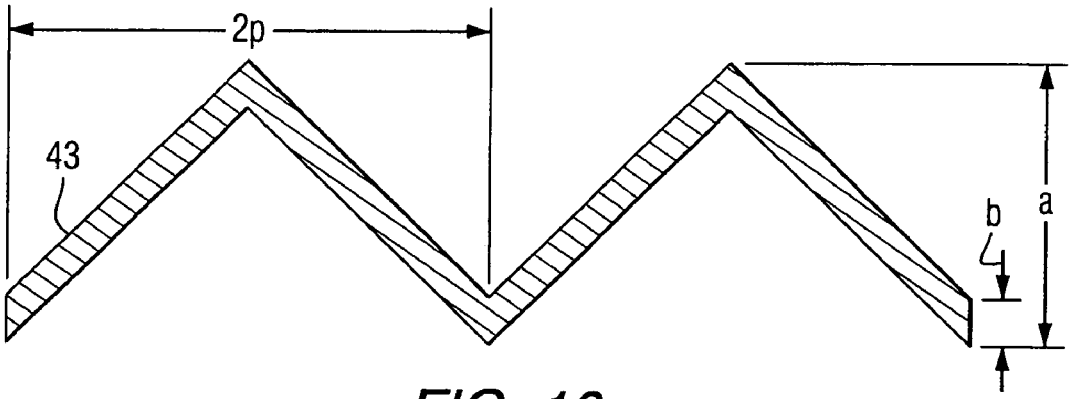

FIG. 10 illustrates a triangular meanderline periodic slow wave structure 43 (i.e., zig-zag meanderline), that also exhibits an approximately constant propagation factor over a band of frequencies. The relevant dimensions governing the ω-β characteristics are indicated in FIG. 10.

Returning to FIG. 4B, the periodic slow wave structure 20 includes terminating points 30 and 32 for connection to the elements of the antenna 10 of FIG. 3. Specifically, FIG. 10A illustrates two periodic slow wave structures 20, one affixed to each of the vertical conductors 12, to form an antenna 44. One of the terminating points, for instance the terminating point 30, is connected to the horizontal conductor 14 and the terminating point 32 is connected to the vertical conductor 12. The second of the two periodic slow wave structures 20 illustrated in FIG. 11A is configured in a similar manner.

Figure 11A:
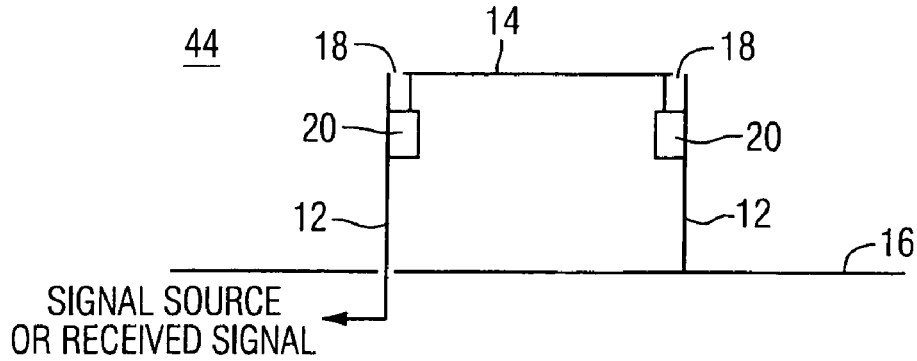
FIGS. 11A and 11B illustrate two embodiments for placement of the periodic slow wave structures relative to the antenna elements.
Figure 11B:
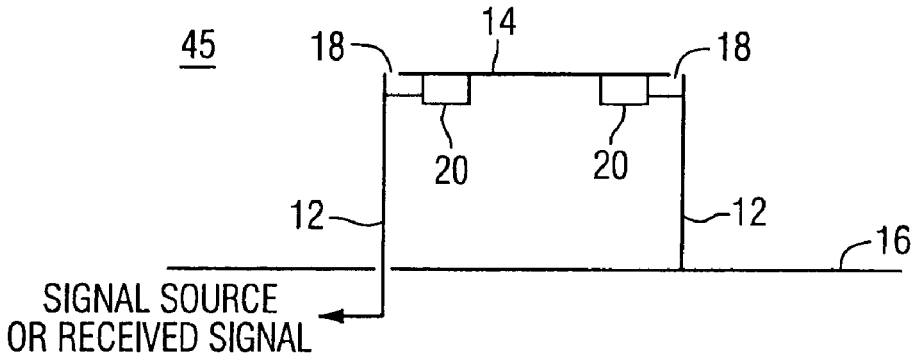

FIG. 11B shows the meanderline couplers 20 affixed to the horizontal conductor 14, forming an antenna 45, with the terminating points 30 and 32 are connected to the vertical conductors 12 and the horizontal conductor 14, respectively, so as to interconnect the vertical conductors 12 and the horizontal conductor 14 across the gaps 18. In both FIGS. 11A and 11B, one of the vertical conductors includes the signal source feed point when operative in the transmit mode or the point from which the received signal is taken when operative in the receive mode.

The operating mode of the antennas 44 and 45 in FIGS. 11A and 11B depends upon the relationship between the antenna operating frequency and the antenna effective electrical length, including the antenna elements and the periodic slow wave structures 20. Thus the operational characteristics of the meanderline-loaded antennas 44 and 45, like all antennas, are determined by the relationship between the effective electrical length and the transmit signal frequency in the transmit mode or the received frequency in the receiving mode. Use of the periodic slow wave structures as taught by the present invention provides broadband or multi-band operation over an indicated frequency range as the phase velocity changes with frequency while the propagation factor and thus the wavelength remain relatively constant to provide a resonant condition over the frequency range.

Figure 12:
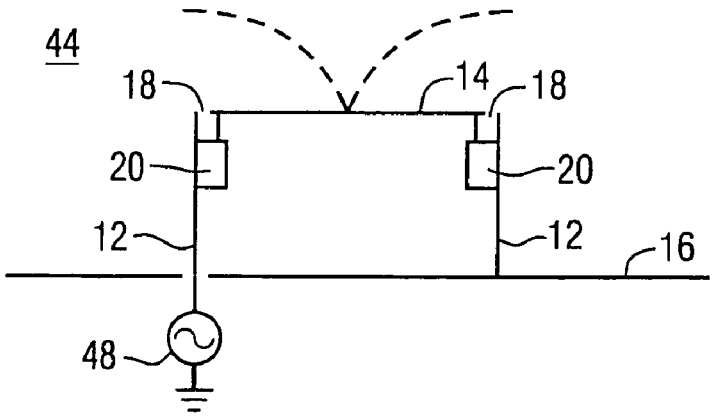
FIGS. 12 through 15 illustrate exemplary operational modes for an antenna constructed according to the teachings of the present invention.
Figure 13:
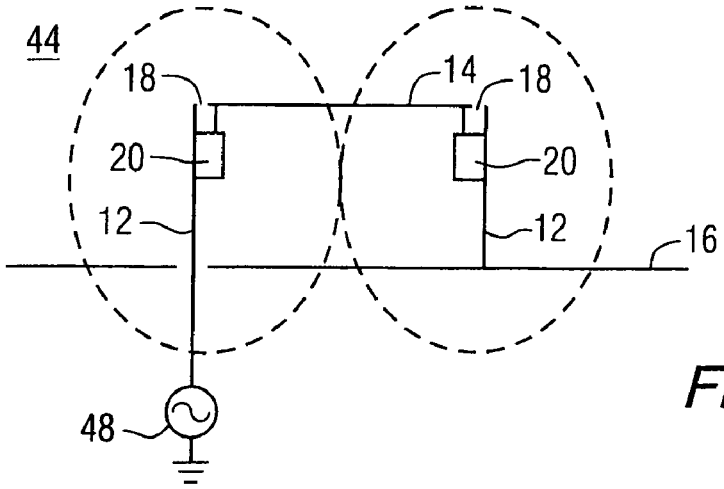

Turning to FIGS. 12 and 13, there is shown the current distribution (FIG. 12) and the antenna electric field radiation pattern (FIG. 13) for the antenna 44 operating in a monopole or half wavelength mode (i.e., the effective electrical length is about one-half of a wavelength) as driven by an input signal source 48. That is, in this mode, the dimensions of the periodic slow wave structures 20 are established such that the antenna 44 resonates over a frequency range between approximately 1 and 3 and the effective electrical length of the periodic slow wave structures 20, the horizontal conductor 14 and the vertical conductors 12 is chosen such that the horizontal conductor 14 has a current null near the center and current maxima at each edge. As a result, a substantial amount of radiation is emitted from the vertical conductors 12, and little radiation is emitted from the horizontal conductor 14. The resulting field pattern has the familiar omnidirectional donut shape as shown in FIG. 13.

Those skilled in the art will realize that the frequency range set forth above is merely exemplary. Further, the dimensions, geometry and material of the antenna components (the periodic slow wave structures 20, the horizontal conductor 14, the ground plane 16 and the vertical conductors 12) can be modified by the antenna designer to create an antenna having different antenna characteristics at other frequencies or frequency bands.

Figure 14:
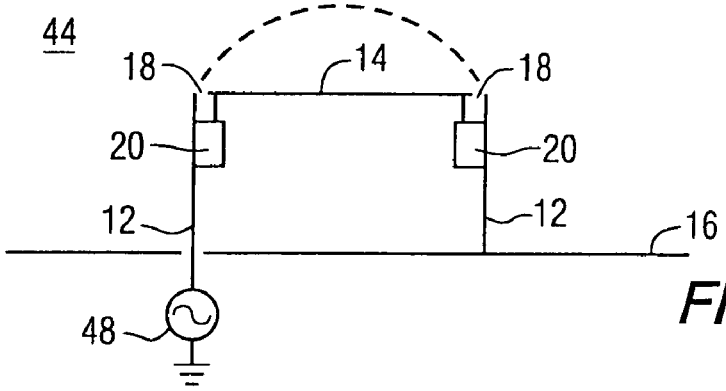
Figure 15:
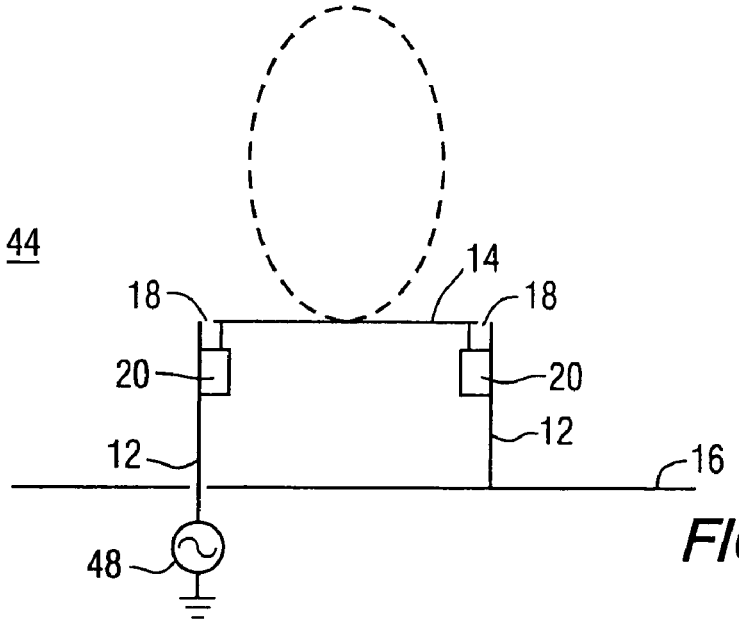

A second exemplary operational mode for the meanderline-loaded antenna 44 is illustrated in FIGS. 14 and 15. This mode is the so-called loop mode, operative when the ground plane 16 is electrically large compared to the effective length of the antenna and wherein the electrical length is about one wavelength at the operating frequency. In this mode the current maximum occurs approximately at the center of the horizontal conductor 14 (see FIG. 14) resulting in an electric field radiation pattern as illustrated in FIG. 15.

The antenna characteristics displayed in FIGS. 14 and 15 are based on an antenna of twice the effective electrical length (including the length of the periodic slow wave structures 20) as the antenna depicted in FIGS. 12 and 13. An antenna incorporating periodic slow wave structures as taught by the present invention can be designed to operate in either of the modes described above. Further, since certain periodic slow wave structures exhibit two frequency bands where the propagation constant is relatively constant with respect to frequency (for example, the bands $\Delta\omega_1$ and $\Delta\omega_2$ in FIG. 2), such an antenna can operate in these two bands dependent on the applied signal frequency.

By changing the geometrical features of the antenna constructed according to the teachings of the present invention, the antenna can be made operative in other frequency bands, including the FCC-designated ISM (Industrial, Scientific and Medical) band of 2400 to 2497 MHz.

As is known by those skilled in the art, the various antenna embodiments constructed according to the teachings of the present invention can be used in an antenna array to achieve improved performance characteristics.

While the invention has been described with reference to preferred embodiments, it will be understood by those skilled in the art that various changes may be made and equivalent elements may be substituted for elements thereof without departing from the scope of the present invention. In addition, modifications may-be made to adapt a particular situation more material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An antenna having an operating bandwidth, the antenna comprising:

a radiating element; and a slow wave structure comprising a conductive material and conductively connected to the radiating element, the slow wave structure having a propagation factor beta that is functionally dependent on an operating frequency, characteristics of the conductive material and a geometry of the slow wave structure, wherein the operating bandwidth is substantially limited to the bandwidth of the slow wave structure defined by a frequency range between a first frequency and a second frequency between which the propagation factor beta is substantially constant relative to the frequency omega.

2. The antenna of claim 1 wherein the antenna is resonant between the first frequency and the second frequency.

* * * * *